US010184486B2

(12) United States Patent
Moujdin et al.

(10) Patent No.: US 10,184,486 B2
(45) Date of Patent: Jan. 22, 2019

(54) HIGH PERFORMANCE MINI-PUMP FOR LIQUIDS

(71) Applicant: KING ABDULAZIZ UNIVERSITY, Jeddah (SA)

(72) Inventors: Iqbal Ahmed Moujdin, Jeddah (SA); Ahmad Hussain Abdulkarim, Jeddah (SA); Hani Hussain Sait, Jeddah (SA)

(73) Assignee: King Abdulaziz University, Jeddah (SA)

( * ) Notice: Subject to any disclaimer, the term of this patent is extended or adjusted under 35 U.S.C. 154(b) by 461 days.

(21) Appl. No.: 14/981,801

(22) Filed: Dec. 28, 2015

(65) Prior Publication Data

US 2017/0184122 A1 Jun. 29, 2017

(51) Int. Cl.

| | |
|---|---|
| ***F04D 1/00*** | (2006.01) |
| ***F04D 29/42*** | (2006.01) |
| ***F04D 13/02*** | (2006.01) |
| ***F04D 29/58*** | (2006.01) |
| ***F04D 29/22*** | (2006.01) |
| ***F04D 29/043*** | (2006.01) |

(Continued)

(52) U.S. Cl.

CPC ..... *F04D 29/4293* (2013.01); *F04D 1/00* (2013.01); *F04D 13/02* (2013.01); *F04D 29/026* (2013.01); *F04D 29/043* (2013.01); *F04D 29/22* (2013.01); *F04D 29/5806* (2013.01); *F04D 29/628* (2013.01)

(58) Field of Classification Search

None

See application file for complete search history.

(56) References Cited

U.S. PATENT DOCUMENTS 2,764,099 A 9/1956 Wernert
3,145,912 A 8/1964 Weis (Continued)

FOREIGN PATENT DOCUMENTS

CN 101598131 A 12/2009
CN 102588334 A 7/2012

(Continued)

OTHER PUBLICATIONS

Carbon Fiber Reinforced Ploymer (CFRP), Schunk Graphite Technology, LLC. Website, http://www.schunkgraphite.com/en/sgt/CarbonFiberReinforcedPolymer/schunk01.c.39108.en.

*Primary Examiner* — Igor Kershteyn
*Assistant Examiner* — Jason Fountain
(74) *Attorney, Agent, or Firm* — Richard C. Litman

(57) ABSTRACT

The high performance mini-pump for liquids includes a motor assembly including a motor to supply power to the pump, and a housing assembly including a housing. The housing has a first housing portion and a second housing portion removably connected to the first housing portion defining an inner chamber therein. The housing assembly also includes an impeller provided in the inner chamber of the housing, and at least one fastening member to removably connect the first housing portion and the second housing portion. The pump further comprises a shaft assembly removably connected to the impeller and operatively connected to the motor, such that when the high performance pump is activated, the motor rotates the impeller, forcing fluid to flow through the housing.

18 Claims, 5 Drawing Sheets

(51) Int. Cl.
*F04D 29/62* (2006.01)
*F04D 29/02* (2006.01)

(56) References Cited

U.S. PATENT DOCUMENTS

| | | | | | |
|---|---|---|---|---|---|
| 3,773,432 | A | * | 11/1973 | Chow | F04D 29/506 415/203 |
| 3,826,589 | A | | 7/1974 | Frank et al. | |
| 3,851,993 | A | * | 12/1974 | Foster | A47L 15/4225 415/200 |
| 3,876,327 | A | | 4/1975 | Lobanoff | |
| 3,932,068 | A | * | 1/1976 | Zimmermann | F04D 29/026 310/104 |
| 4,052,133 | A | | 10/1977 | Yeater | |
| 5,407,323 | A | | 4/1995 | Gay et al. | |
| 6,012,900 | A | * | 1/2000 | Kennedy | F04D 29/0413 415/170.1 |
| 2006/0018762 | A1 | | 1/2006 | Aisenbrey | |
| 2008/0076619 | A1 | | 3/2008 | Scott et al. | |

FOREIGN PATENT DOCUMENTS

| | | | |
|---|---|---|---|
| DE | 10051731 | A1 | 5/2002 |
| DE | 102007006915 | A1 | 8/2008 |
| JP | S 64-60651 | A1 | 3/1989 |

* cited by examiner

HIGH PERFORMANCE MINI-PUMP FOR LIQUIDS

BACKGROUND OF THE INVENTION

1. Field of the Invention

The present invention relates to centrifugal pumps, and more particularly to a high performance mini-pump for liquids having a polymer composite housing assembly and detachable components.

2. Description of the Related Art

Centrifugal pumps generally facilitate pressurized flow of fluid and/or gas in supply systems. Conventional centrifugal pumps and components are cast of metal alloys, which have some disadvantages. Particularly, pumps constructed and/or using metal components can be susceptible to corrosion when operating with fluids. The corrosive effects on metal components in pumps can reduce the pump's efficiency, lead to cavitation, and possibly cause catastrophic wear and tear. It is estimated that as a result of corrosion, the overall drop in competence for an unmanned metal pump can be between 10 to 15 percent, within the first year. With repeated fluid exposure, corrosion, cavitation, and subsequent pressure loss can occur. Accordingly, it is estimated that an unmanned pump can fail catastrophically in less than 20 years of service.

Thus, a high performance mini-pump for liquids solving the aforementioned problems is desired.

SUMMARY OF THE INVENTION

The high performance mini-pump for liquids includes a pump housing having a first housing portion and a second housing portion removably connected to the first housing portion to define an inner chamber therein. At least one fastening member removably connects the first housing portion and the second housing portion. An impeller has a body rotatable in the inner chamber of the housing. A shaft assembly is removably connected to the impeller and to a DC motor for rotating the impeller.

The first housing portion and second housing portion are made from a polymer composite. The impeller is also made from a polymer composite. The first housing portion includes a first channel formed on an inner surface of the first housing portion to facilitate fluid flow therein. The second housing portion includes a second channel formed on an inner surface of the second housing portion to facilitate fluid flow therein.

The inlet of the housing is provided on a first side of the impeller and the outlet of the housing is provided on an opposing second side of the impeller. The impeller has a series teeth formed along the outer edges of the impeller at generally 45° relative to the inner wall of the housing. The impeller also has a series of fins or blades formed along the surface of the impeller to facilitate fluid flow in the housing. The drive shaft is removably connected to a second side of the impeller by an impeller lock, and the motor assembly is operatively connected to an opposing first side of the impeller via the shaft assembly.

The first housing portion and second housing portion each have respective openings formed therein to receive a corresponding fastening member to form a secure integral connection between the first housing portion and second housing portion. The pump operates bi-directionally, in a first direction and a second direction. The at least one fastening member includes a bolt and screw combination to securely connect the first housing portion to the second housing portion. When the high performance pump is activated, the motor rotates the impeller, thus forcing fluid to flow through the inlet and out the outlet of the housing. These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The high performance mini-pump, in an embodiment generally referred to by the reference number 10, includes an integrally formed polymeric housing and impeller, operatively connected for delivering pressurized fluid F and/or gas to a connected system. The polymeric pump components reduce the pump's overall susceptibility to corrosion, thereby reducing maintenance and/or replacement cost of the pump 10. Further, the polymeric pump components are removably connected, permitting a user to easily access the pump internally, thus reducing the cost to service and maintain the pump 10.

Figure 1:
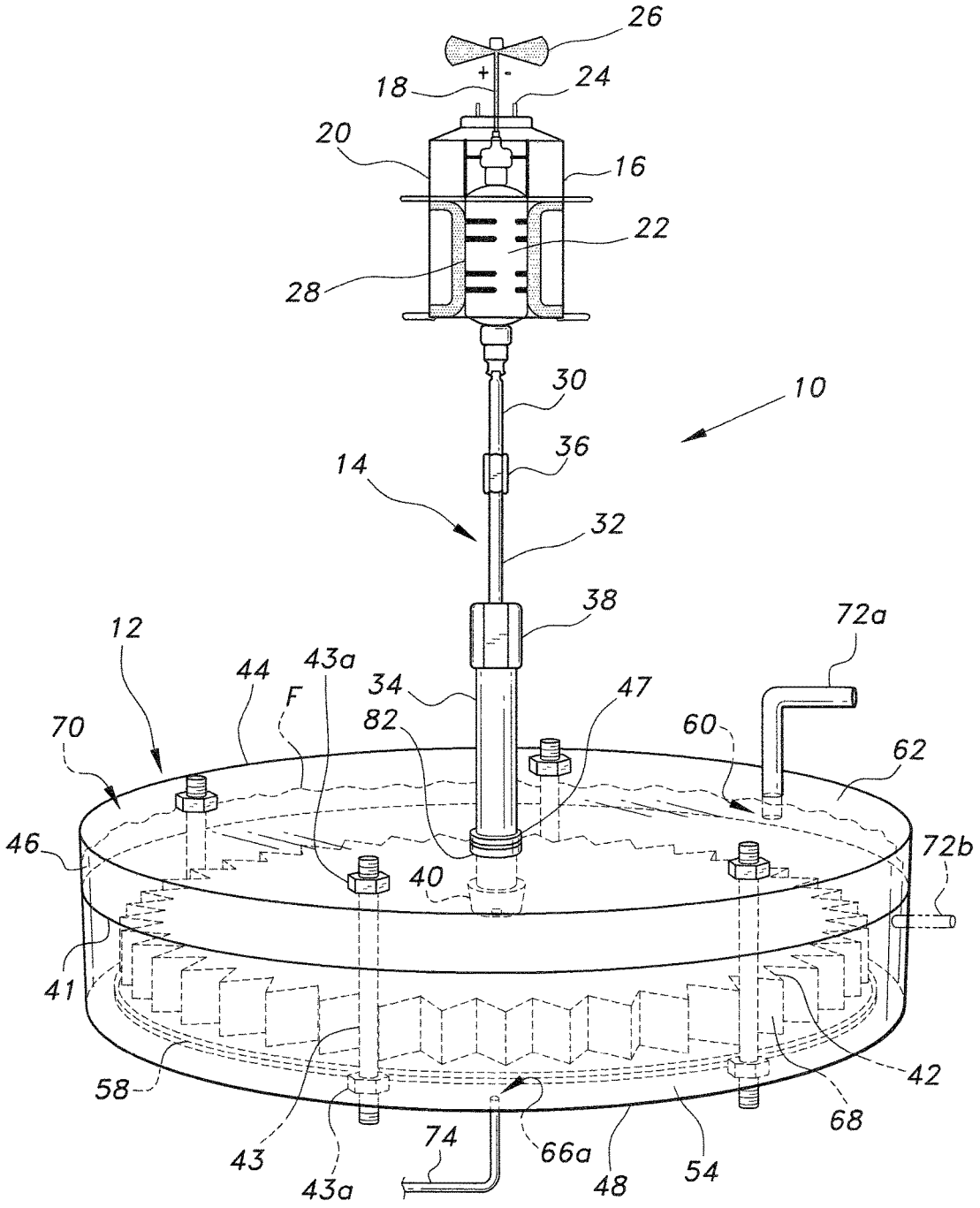
FIG. 1 is a perspective view of a high performance mini-pump for liquids according to the present invention.

Referring now to FIG. 1, there is shown pump 10, provided in a generally vertical orientation. The pump 10 includes a housing assembly 12 for controlling and facilitating fluid flow therethrough, a drive shaft assembly 14 operatively connected to the housing assembly 12 for transferring power into the housing assembly 12, and a motor assembly 16 for powering the drive shaft assembly 14 and operatively connected housing components. As shown, the motor assembly 16 is provided in a generally upper portion 18 of the pump 10. The shaft assembly 14 is connected to the motor assembly 16, extending in a generally downward direction therefrom, operatively connecting the motor assembly 16, and components provided by the housing assembly 12. It should be noted that although FIG. 1 illustrates the pump 10 in a generally vertical orientation, the pump 10 can also be positioned in a generally horizontal orientation, as well as any other orientation requiring the operation of a pump.

The pump 10 can be a self-priming discharge pump. Further, the pump 10 may be adapted to selectively pump bi-directionally; e.g., in forward and/or reverse directions, to facilitate fluid flow in and out of the housing assembly 12, as selected by the user. While the pump 10 fluid discharge capacity can be varied, it is contemplated that the pump 10 can be adapted to provide a fluid discharge capacity of at least 10 gallons per minute or more, however, other flow parameters are contemplated without departing from the scope of the invention.

The motor assembly 16 is operatively connected to the shaft assembly 14, providing a rotational torque force to selectively rotate the shaft assembly 14 in a forward and/or reverse direction. The motor assembly 16, generally includes a motor 20, a gear box 22 for converting high-torque rotation of the motor 20 into a faster rotation, a power supply 24 for providing power to the motor 20, and a cooling device 26, such as a fan, for cooling the motor 20 and other components during operation.

The motor 20 is adapted to receive power from the power supply 24, and transfer that power into rotational torque along the shaft assembly 14, in a forward or reverse direction. As shown, the motor 20 includes internal commutation, and stationary permanent magnets 28. Further, the motor 20 can be a high rpm motor, such as a 12 Volt (3000 rpm, 40-70 watts) DC motor 20, or any suitable type of motor capable of driving the shaft assembly 14 at a preselected desired rate of speed.

The fan 26 is adapted to cool the motor 20 to prevent the motor 20 from overheating during operation. The cooling capacity of the fan 26 can be programmable to correspond to the speed of the motor 20, such that when the motor speed increases, the speed of the fan 26 increases proportionately, thereby reducing the susceptibility of the motor 20 to overheating. As shown, the fan 26 may be positioned proximate to the motor 20 to enhance cooling efficiency.

As shown, the shaft assembly 14 extends generally outward from the motor assembly 16, operatively connecting the housing assembly 12 to the motor assembly 16, and transferring torque generated by the motor assembly 16 into the housing assembly 12. The shaft assembly 14 includes a drive shaft, which includes a first shaft portion or first rotating shaft 30, a second shaft portion or second rotating shaft 32, and a third shaft portion or impeller rotating shaft 34.

The first shaft portion 30 and second shaft portion 32 are connected via a first clamping device 36, or first socket 36. The second shaft portion 32 and third shaft portion 34 are connected via a second clamping device 38, such as a second socket 38. The second socket 38 is dimensioned for engagement with the second shaft portion 32 and third shaft portion 34. The third shaft portion 34 engages the housing assembly 12 to transfer rotational torque from the shaft assembly 14 to the housing assembly 12 and is secured with clamping device 47.

The housing assembly 12 includes a housing 44 having a generally cylindrical configuration. The housing 44 includes a first housing portion 46, or upper housing case 46, and a second housing portion 48, or lower housing case 48. As shown the first housing portion 46 and second housing portion 48 are removably connected along the seam 41, forming an integral unit. The composite housing structure 44 is corrosive resistant. The housing 44 can be fabricated from a carbon fiber-reinforced polymer or carbon fiber molded, reinforced engineered, and commodity polymer, such as, for example, carbon fiber-reinforced polyester. The ratio (by weight %) of polymer composite can be 1:2, however other composite formulations are contemplated. It is further contemplated that the polymer can include unsaturated polyethylene, terephthalate, polystyrene, flouroethylene terephthalate, flouroethylene carbonate, flouroethylene urethane, Bisphenol A, B and F or the composite blend thereof.

The housing assembly 12 further includes one or more fastening or connecting members 43 for securely connecting the first housing portion 46 and the second housing portion 48 together integrally. The fastening members 43 can include detachable ties, such as a screw and bolt (43*a*) combination or the like. As shown in FIG. 1, the housing assembly 12 includes four screw and bolt combinations to secure the housing portions 46, 48 integrally, however it is contemplated that additional and/or fewer fastening members 43 can be used. Moreover, other types of relatively easily removable fasteners such as quick-release clamps and the like are also contemplated. The housing assembly 12 further includes an impeller rotor 42 disposed in the housing 44 to facilitate fluid flow therethrough, the impeller rotor 42 being operatively connected to the third shaft portion 34.

As shown in FIGS. 1, 3, 4, 5A, and 5B, the first housing portion 46 includes an outer portion 50 and an inner portion 52. The second housing portion 48 includes an outer portion 54, and inner portion 56. When the second housing portion 48 and first housing portion 46 are removably connected, the inner portion 52, of the first housing portion 46, and the inner portion 56, of the second housing portion 48, define an inner chamber 70 within the housing 44 configured to receive the impeller 42 and fluid flow therethrough. The first housing portion 46 includes one or more openings 51 adapted to receive corresponding fastening members 43. These openings 51 can be threaded as shown or smooth depending on the type of fastening members to be used.

Figure 5A:
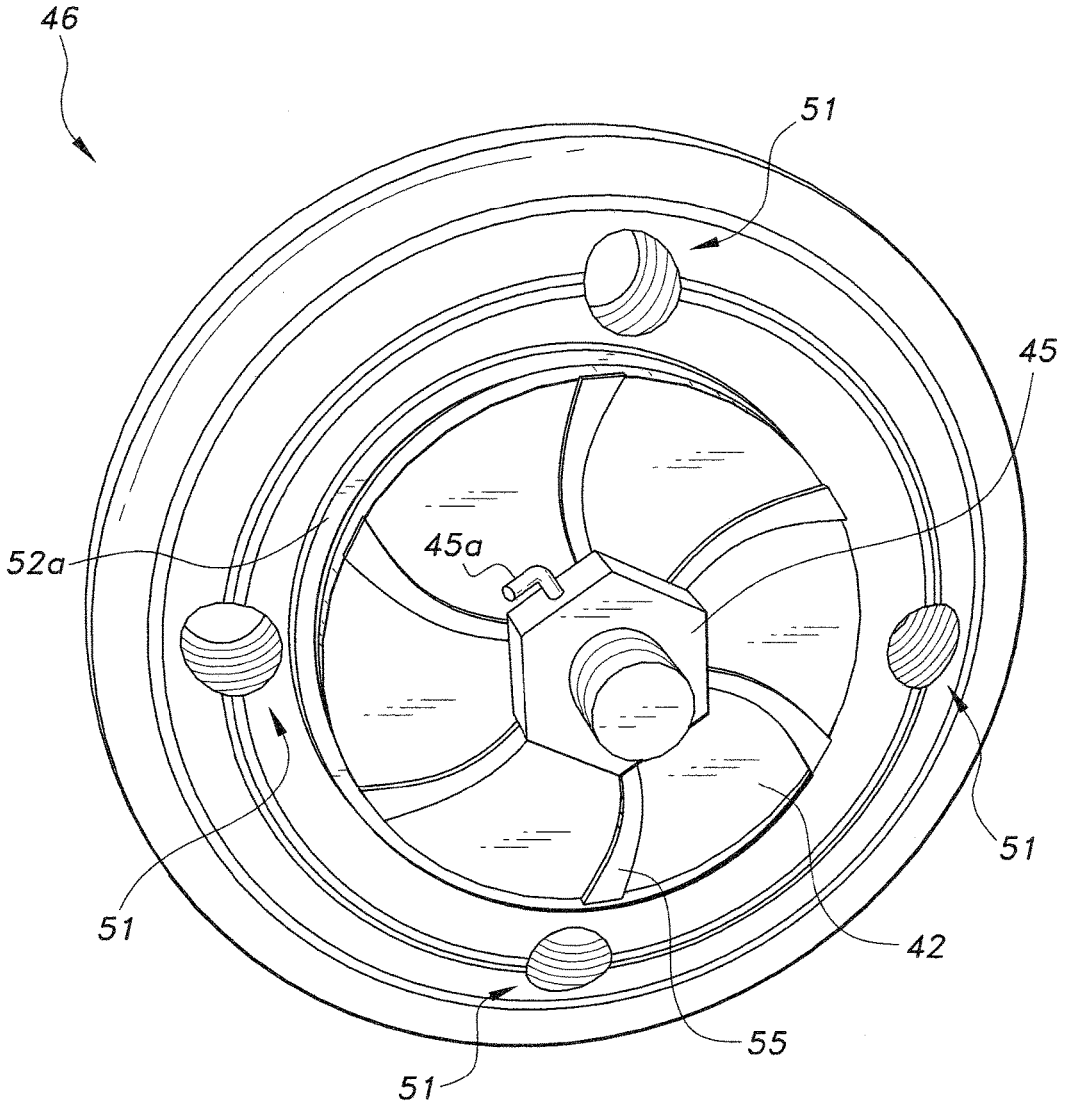
FIG. 5A is a perspective view of the first housing portion of the high performance mini-pump, according to the present invention.
Figure 5B:
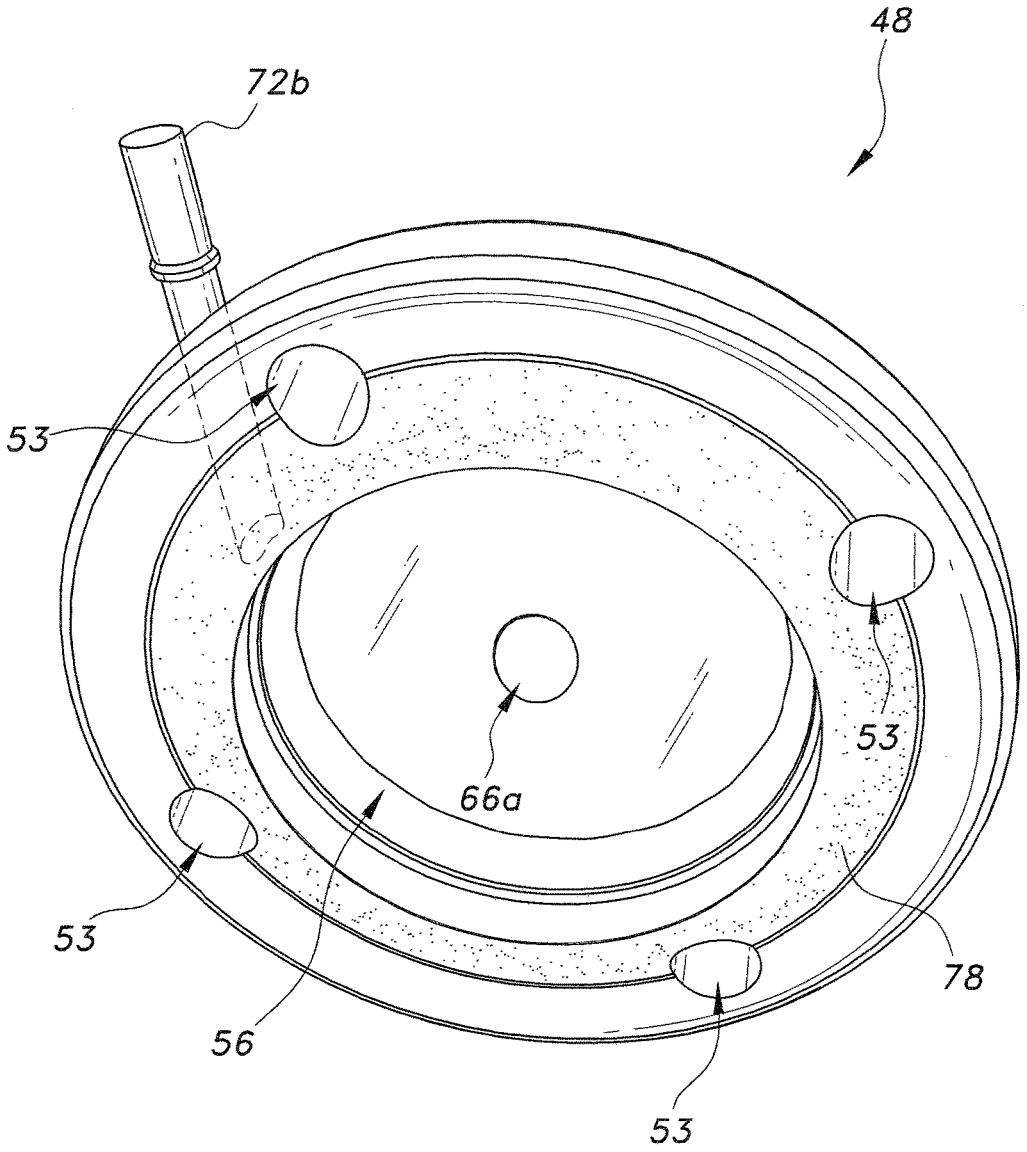
FIG. 5B is a perspective view of the second housing portion of the high performance mini-pump, according to the present invention.

As shown in FIG. 5B, the second housing portion 48 includes one or more openings 53, adapted to also receive a corresponding fastening member 43. As shown, the housing 44 further includes one or more inlets 74 and one or more outlets 72*a* provided in the housing 44 to permit fluid flow and pressure therethrough. The inlet 74 and outlet 72*a* each preferably has a dimension greater than the cross sectional dimension of the impeller rotating shaft 34. In an embodiment, one or more, fluid inlets 74 are provided to enhance fluid flow through the pump 10. As shown, the inlet 74 is provided on a first side of the impeller 42 and the outlet 72*a* is provided on an opposing second side of the impeller 42. A transmission gasket 78 is provided on the second housing portion 48 to provide a seal between the second housing portion 48 and first housing portion 46.

As shown, the impeller 42 is generally disposed in the inner chamber 70 in spaced relationship with the first housing portion 46 and second housing portion 48 to facilitate fluid flow and fluid pressure therein. As shown, the impeller 42 can be provided in a generally central position in the inner chamber 70, dividing the inner chamber 70 into approximately two parts.

Figure 2:
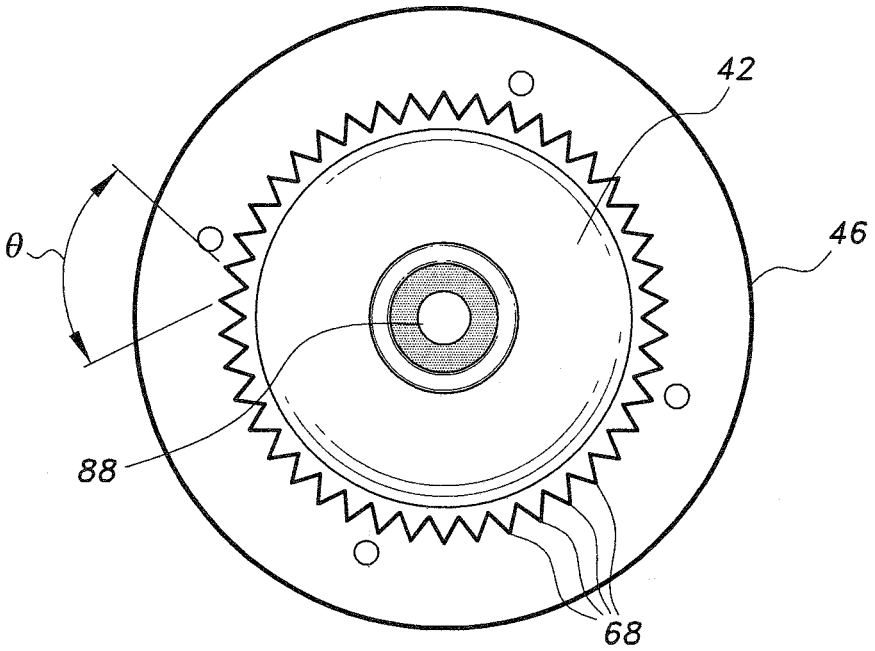
FIG. 2 is bottom view of a first housing portion of the high performance mini-pump of FIG. 1, shown with the impeller in place.

Continuing to FIG. 2, the impeller 42 can include or be customized by a carbon fiber reinforced plastic composite, which also can be a polyolefin/aromatic polymer composite as well. It is further contemplated that the impeller 42 can be constructed by an anticorrosion alloy or can be casted by carbon fiber reinforced plastic tied by stainless steel cut screws. It is noted that polyolefin surfaces exhibit excellent chemical inertness, and as a result, they are not effectively joined together by solvent welding and are unaffected by common solvents. Aromatic polymers are generally a class of fibers that exhibit excellent heat-resistance and strength. While a polyolefin/aromatic surface is contemplated, notably other similar polymers or plastics can be used for the housing without departing from the scope of the present invention.

The impeller 42 includes a plurality of impeller blades or teeth 68, which extend generally radially outward towards the periphery of the impeller 42, facilitating fluid movement within the inner chamber 70 when the impeller 42 is rotated. In an embodiment, the impeller blades 68 are angled at θ degrees relative to the inner surface of the housing 44, which can be approximately 45 degrees. As illustrated in FIG. 5A, it is also contemplated that the impeller 42 can include one or more fins 55 formed on the surface of the impeller 42 to facilitate fluid flow within housing 44.

The impeller rotating shaft 34 enters the first housing portion 46 through an opening 82 formed therein and the fluid sealing bearing 40 detachably secures the impeller rotating shaft 34 to an upper portion of the impeller 42. As shown in FIG. 5A, a lower portion of the impeller 42 is detachably connected to the shaft portion 34 by one or more fastening members 45. The fastening member 45 can also be provided with a shaft lock 45*a* to positively lock the fastening member 45 onto the impeller rotating shaft 34. This will substantially prevent potential loosening of the fastening member 45 during operation. The shaft lock 45*a* can be a cotter pin, a threaded pin, and the like. The fastening member 45 can be stainless steel bolt and nuts, corrosive resistant connecting members, or an integral nut member of the impeller 42. Notably, other means for detachably securing the impeller 42 to the drive shaft 34 with the housing 44 are contemplated. In an embodiment, corrosion resistant polymer bolts or screws can be used to secure the impeller 42.

The components of the pump housing 44 are connected and detachable by detachable ties such as by the fastening members 43. The fastening members 43 enable the housing portions 46 and 48 to be easily disassembled, permitting replacement and repair of the impeller 42 and/or other necessary maintenance. In an embodiment, the fastening members 43 can be provided as elongate bolts inserted through corresponding openings 51, 53 to secure the housing portions 46, 48 with one or more nuts 43*a*. The bolts and/or the nuts 43*a* can be fabricated from a polymeric corrosive resistant material.

As shown in FIG. 1, the impeller 42 is provided in a generally lateral orientation relative to the housing 44. The inlet 74, in communication with the opening 66*a* and outlet 72*a*, cooperatively facilitates fluid flow through the housing 44. As shown, the inlet 74 is provided, in a generally lower position of the housing relative to the impeller 42 to provide fluid flow through the opening 66*a*. The outlet 72*a* is provided to facilitate fluid flow through and enabling equal fluid pressure to form on opposing sides of the impeller 42 providing an equaling pressurized split housing 44. As previously stated, and shown in FIG. 2, it is also contemplated that the pump assembly 10 can be positioned horizontally, e.g., a perpendicular orientation to that shown in FIG. 1, and as such, the impeller 42 will assume vertical orientation. The impeller rotor 42 is positioned in spaced relationship within the assembled housing portions 46 and 48.

The fluid sealing bearing 40, also identified as an impeller support 40, receives the third shaft portion 34 of the drive shaft, proximate to the housing assembly 12. As shown, the fluid sealing bearing 40 seals fluid inside of the housing assembly 12. The bearing 40 receives the impeller rotating shaft 34 therein to facilitate shaft rotation relative to the housing 44, and further connect the shaft assembly 14 to housing assembly components 12, like an impeller 42. These connections facilitate the rotation of the third shaft portion 34 of the shaft assembly 14, relative to the housing assembly 12. Notably, the pump 10 can also be a multistage centrifugal pump, wherein two or more impellers 42 can be mounted within the housing 44, without departing from the scope of the present invention.

Figure 3:
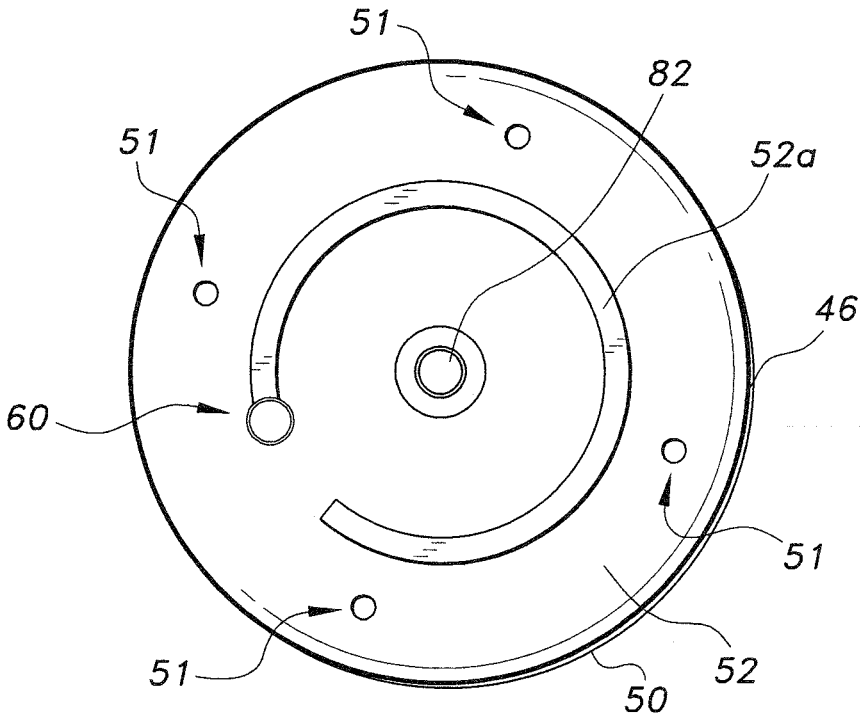
FIG. 3 is a top view of the inner surface of the first housing portion of the high performance mini-pump of FIG. 1 with an impeller removed, according to the present invention.

As shown in FIG. 3, the inner portion 52, which can also be referred to as an inner lining 52, of the first housing portion 46 and the impeller rotor 42 include a first cut water section 52*a*, providing a cut water feature for continuous circular fluid flow therein. The first cut water section 52*a* provides an arch protrusion or wall formed in the inner lining 52 of the inner portion 52. Fluid flowing through the housing 44, and inner chamber 70, is engaged by the impeller 42 and travels along the first cut water section 52*a*. The first cut water section 52*a* is formed as a generally rounded arched wall and is configured such that in use, the velocity and/or turbulence resulting from the fluid being pumped into a main inner chamber is reduced by dividing the stream. The housing portion 46 further comprises a first opening 60 extending through the inner portion 52, providing an outlet 72*a* for fluid to flow from the housing. Alternatively, it is contemplated that the outlet 72*b* can be provided on the side of housing 44 to permit the fluid to flow therefrom.

Figure 4:
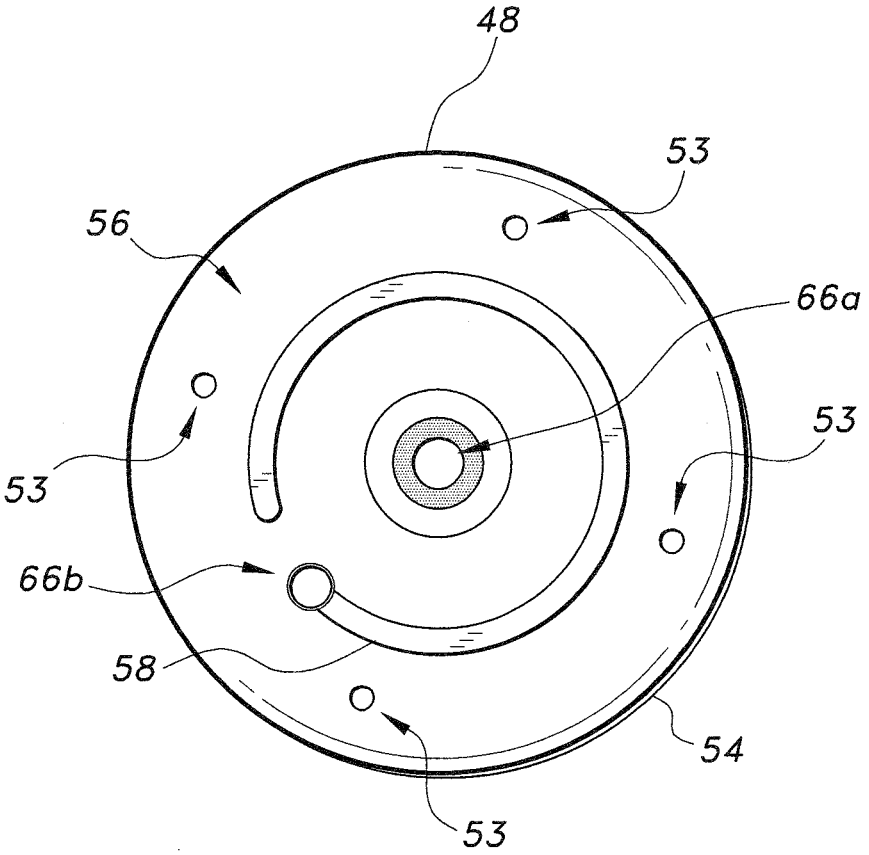
FIG. 4 is a top view of a second housing portion of the high performance mini-pump housing, according to the present invention.

The first housing portion 46 and/or the second housing portion 48 can include a generally polyester/polystyrene blend polymer composite. As shown in FIG. 4, the second housing portion 48 has the inner portion 56 which includes a second cut water section 58 to facilitate fluid flow and rotation through the housing 44, for rotating fluid continually therein. The inner portion 56 can also be referred to as an inner lining 56. The second cut water section 58 has a generally circular configuration, for facilitating fluid flow along the protrusion or wall formed by the second cut water section 58 and within the housing 44. The second housing portion 48 of the housing 44 further includes an opening 66*a*, the opening 66*a* communicating with the inlet 74. The inlet 74 extends through the inner lining 56, inside of the housing 44, enabling fluid flow into the inner chamber 70. Alternatively, an opening 66*b* can be provided to communicate with the second cut water section 58, and enable fluid to flow through an alternative inlet.

The fluid inlet 74 and outlet 72*a* are in spaced non-contacting relationship, such that fluids that enter the housing 44 travel around the housing 44 from entrance to exit. As shown, the inlet 74 and outlet 72*a* can be positioned on generally opposing sides of impeller 42 in the housing inner chamber 70. However, notably, it is contemplated that the fluid inlet 72*a* and outlet 74 can be provided at any location on the housing 44 without departing from the scope of the present invention In operation, the pump 10 receives a signal from an associated controller to commence pumping and the pump 10 is activated. The motor assembly 16 activates the motor 20 to operate at a preselected speed as fluid enters the inlet 74 of the housing 44. The impeller 42, in operative connection with the motor 20, rotates circularly inside of the pump housing 44 creating a centrifugal force on the fluid F. This motion curves along the path of the fluid F to move circularly inside of the housing 10. As such, the forces on the fluid F are generally inward, centripetal, and the fluid moves in a circular path. A pressure gradient providing the force created by the rotation, and pressure is generated. Fluid F travels along the first cut water section 54 and second cut water section 58 formed in the respective housing 44 portions 46, 48 and pressure forces the fluid F through the outlet 72*a* and/or 72*b* in a pressurized state.

It is to be understood that the present invention is not limited to the embodiments described above, but encompasses any and all embodiments within the scope of the following claims.

We claim:

1. A high performance pump, comprising:

a motor assembly including a motor;

a housing assembly including a housing having a first housing portion and a second housing portion, the second housing portion being removably connected to the first housing portion, wherein the first housing portion includes a first cut water section formed on an inner surface thereof to facilitate fluid flow therein, the housing defining an inner chamber therein and including an inlet and an outlet, wherein each of the first and second housing portions has a substantially circular contour, the housing forming a substantially cylindrical shell;

at least one fastening member for removably connecting the first housing portion to the second housing portion;

an impeller co-axially mounted in the inner chamber of the housing; and a shaft assembly removably connected to the impeller and operatively connected to the motor, such that when the high performance pump is activated, the motor rotates the impeller, thereby forcing fluid to flow through the inlet and out the outlet of the housing.

2. The high performance pump of claim 1, wherein the first housing portion and second housing portion are each formed from a polymer composite.

3. The high performance pump of claim 1, wherein the impeller is formed from a polymer composite.

4. The high performance pump of claim 1, wherein the second housing portion includes a second cut water section formed on an inner surface thereof to facilitate fluid flow therein.

5. The high performance pump of claim 1, wherein the inlet of the housing is provided on a first side of the impeller and the outlet of the housing is provided on an opposing second side of the impeller.

6. The high performance pump of claim 1, wherein the impeller has a plurality of teeth formed along an outer edge thereof.

7. The high performance pump of claim 1, wherein the impeller has a plurality of fins formed thereon to facilitate fluid flow in the housing.

8. The high performance pump of claim 1, wherein the drive shaft is removably connected to the impeller.

9. The high performance pump of claim 1, wherein the first housing portion and the second housing portion each have respective openings formed therethrough for receiving the at least one fastening member.

10. The high performance pump of claim 9, wherein the at least one fastening member includes a bolt and a nut.

11. The high performance pump of claim 1, wherein the pump operates bi-directionally.

12. A high performance pump, comprising:

a motor assembly including a motor;

a housing assembly including a housing having a first housing portion and a second housing portion, the second housing portion being removably connected to the first housing portion, the housing defining an inner chamber therein and including an inlet and an outlet, wherein each of the first and second housing portions has a substantially circular contour, the housing forming a substantially cylindrical shell, wherein the housing is formed from a polymer composite material;

at least one fastening member for removably connecting the first housing portion to the second housing portion;

an impeller co-axially mounted in the inner chamber of the housing, wherein the impeller is formed from a polymer composite material, wherein the inlet of the housing is provided on a first side of the impeller and the outlet of the housing is provided on an opposing second side of the impeller; and a shaft assembly removably connected to the impeller and operatively connected to the motor, such that when the high performance pump is activated, the motor rotates the impeller, thereby forcing fluid to flow through the inlet and out the outlet of the housing.

13. The high performance pump of claim 12, wherein the first housing portion includes a first cut water section formed on an inner surface thereof to facilitate fluid flow therein.

14. The high performance pump of claim 13, wherein the second housing portion includes a second cut water section formed on an inner surface thereof to facilitate fluid flow therein.

15. The high performance pump of claim 12, wherein the impeller has a plurality of teeth formed along an outer edge thereof.

16. The high performance pump of claim 12, wherein the impeller has a plurality of fins formed thereon to facilitate fluid flow in the housing.

17. The high performance pump of claim 12, wherein the drive shaft is removably connected to the impeller.

18. The high performance pump of claim 12, wherein the first housing portion and the second housing portion each have respective openings formed therethrough for receiving the at least one fastening member.

* * * * *